United States Patent [19]

English

[11] Patent Number: 4,484,410

[45] Date of Patent: Nov. 27, 1984

[54] INTERIOR SECURITY DOOR PANEL

[75] Inventor: Thomas A. English, Oklahoma City, Okla.

[73] Assignee: Interior Security Corp., Oklahoma City, Okla.

[21] Appl. No.: 430,345

[22] Filed: Sep. 30, 1982

[51] Int. Cl.[3] ..... E05B 65/04
[52] U.S. Cl. ..... 49/63; 49/56
[58] Field of Search ..... 49/56, 57, 62, 63

[56] References Cited

U.S. PATENT DOCUMENTS 4,325,203 4/1982 Wicks ..... 49/56 YR
4,409,757 10/1983 Daugherty ..... 49/56

*Primary Examiner*—Kenneth Downey
*Attorney, Agent, or Firm*—Edwin H. Crabtree

[57] ABSTRACT

An interior security door panel for receipt inside the frame of a stationary and sliding glass door and adjacent thereto. The interior security door panel preventing unlawful entrance through the door.

4 Claims, 2 Drawing Figures

INTERIOR SECURITY DOOR PANEL

BACKGROUND OF THE INVENTION

This invention relates to a door panel and more particularly an interior security door panel for receipt inside the frame of a sliding glass door or the like.

Heretofore, there have been various types of window and patio door security systems such as U.S. Pat. No. 4,226,049 to Maust, U.S. Pat. No. 4,325,203 to Wicks, U.S. Pat. No. 2,222,667 to Kitzelman, U.S. Pat. No. 2,136,042 to Cornell et al, U.S. Pat. No. 1,996,931 to McGuinness, U.S. Pat. No. 988,510 to Rosenzweig, U.S. Pat. No. 3,167,828 to Hutchisson, Jr. and U.S. Pat. No. 4,059,923 to Sauer. None of the mentioned patents specifically disclose the unique features and advantages of the subject security door panel as described herein.

SUMMARY OF THE INVENTION

The interior security door panel is designed for different types and sizes of stationary and sliding glass doors used for patios, homes, buildings and the like. The door panel is attractive in appearance and prevents unlawful entrance through the door from the outside of the building.

The door panel is characterized by being mounted inside the door frame of a sliding glass door so the security door panel cannot be removed from outside of the building.

The interior security door panel is rugged in construction, simple in design and slide parallel with the existing sliding glass door providing full security and convenience to the door.

The interior security door panel for receipt inside the door frame of a stationary glass door and sliding glass door includes a stationary panel frame and a sliding panel frame. Both of the frames include cross members attached to the frames and having a spaced relationship to each other small enough to prevent human entrance therethrough. The sliding panel frame is suspended by "L" shaped roller hangers. The top of the sliding panel frame has a roller arm with rollers extending outwardly therefrom. The rollers are received on top of the roller hangers thereby allowing the sliding panel frame to be moved laterally in front of the glass doors.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
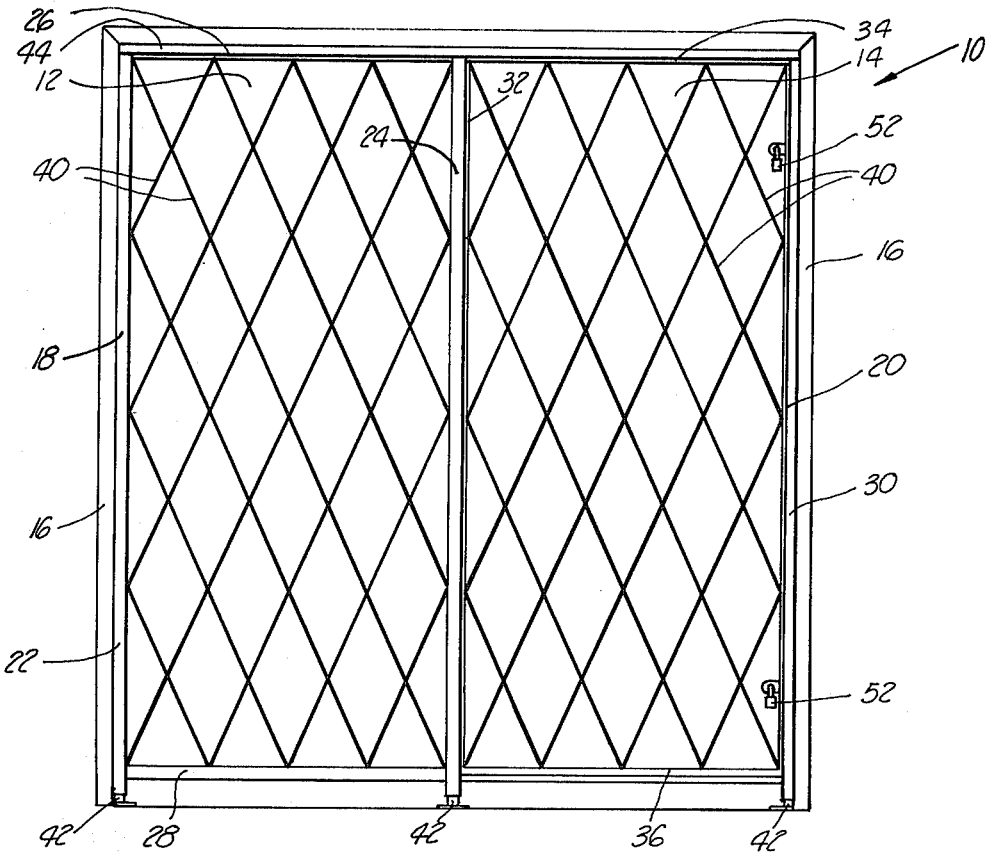
FIG. 1 illustrates a front view of the security door panel mounted in front of a stationary glass door and a sliding glass door.

In FIG. 1 the interior security door panel is designated by general reference numeral 10. The panel 10 is mounted in front of a glass stationary door 12 and a sliding glass door 14. The doors 12 and 14 are mounted inside a door frame 16. The security door panel 10 includes a stationary door frame 18 and a sliding panel frame 20. The stationary panel frame 18 includes side members 22 and 24, upper member 25 and bottom member 28. The sliding panel frame 20 includes side members 30 and 32, upper member 34 and lower member 36. The two frames 18 and 20 further include cross members 40 attached to the frames and as illustrated in FIG. 1 form a diamond configuration with the spacing between the cross members 40 small enough to prevent human entrance therethrough. While the cross members 40 form a diamond configuration, it can be appreciated that also a rectangular configuration or other different types of configurations can be formed which are pleasing to the eye.

The door panel 10 further includes leveling shoes 42 attached to the lower members 28 and 36 of the frames 18 and 20. The leveling shoes 42 allow the frame 10 to be adjusted properly inside the door frame 16.

Figure 2:
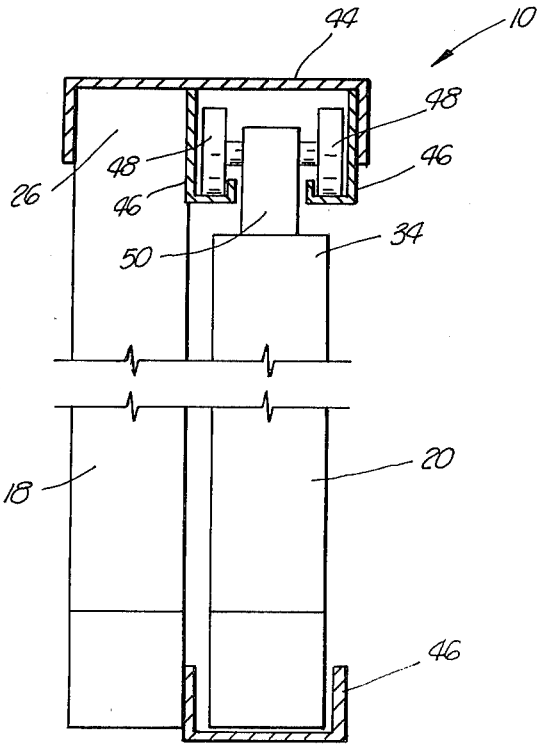
FIG. 2 is a side view of the stationary panel frame and sliding panel frame and illustrating a "U" shaped channel and "L" shaped roller hangers for receiving the rollers attached to the top of the sliding panel frame.

In FIG. 2 a cross section of a "U" shaped channel 44 and a "U" shaped panel guide 46 is shown. The "U" shaped channel 44 is attached along the top of the door frame 16 for receiving the top members 26 and 34 of the frames 18 and 20. The "U" shaped channel 44 further includes "L" shaped roller hangers 46 extending downwardly from the sides of the channel 44 for receiving a pair of rollers 48 therein. The rollers 48 are attached to a roller arm 50 which extends upwardly from the upper member 34 of the sliding panel frame 20. When the sliding panel frame 20 is unlocked from locks 52 shown in FIG. 1, the frame 20 can be quickly moved on the rollers 48 laterally from in front of the sliding glass door 14 into a position in front of the stationary glass door 12 thereby allowing the sliding glass door 14 to be opened for entrance therethrough.

The sliding panel frame 20 is also received in the panel guide 46 to guide the sliding panel frame 20 when the frame 20 is moved back and forth in front of the glass doors 12 and 14 and in front of the stationary panel frame 18.

While the above interior security door panel 10 is shown received in the door frame 16 of the stationary and sliding glass doors 12 and 14 it can be appreciated that the door panel 10 can be used with various configurations of glass doors and other types of doors equally well without departing from the scope and spirit of the subject invention.

Changes may be made in the construction and arrangement of the parts or elements of the embodiments as described herein without departing from the spirit or scope of the invention defined in the following claims.

What is claimed is:

1. An interior security door panel for receipt inside the door frame of a stationary glass door and a sliding glass door and adjacent thereto, the door panel preventing the unlawful entrance through the door, the panel comprising:

a stationary panel frame having a first and second side member and an upper and lower member, the stationary panel frame adjacent the stationary glass door;

a sliding panel frame having a first and second side member and an upper member and lower member, the sliding panel frame adjacent the sliding glass door;

cross members attached to the stationary panel frame and sliding panel frame, the cross members disposed in a spaced relationship to each other with the spacing small enough to prevent human extrance therethrough;

a "U" shaped channel attached along the top of the door frame, the "U" shaped channel receiving the upper member of the stationary panel frame and sliding panel frame therein, the "U" shaped channel further having "L" shaped roller hangers extending downwardly therefrom for receiving rollers attached to a roller arm, the roller arm attached to the top of the sliding panel frame, the rollers engaging the roller hangers and allowing the sliding panel frame to be moved laterally in front of the stationary panel frame.

2. The sliding door panel as described in claim 1 further including a "U" shaped panel guide mounted on the bottom of the door frame for receiving the lower member of the sliding panel frame therein when the sliding panel frame is moved laterally in front of the stationary panel frame.

3. The sliding door panel as described in claim 1 further including leveling shoes attached to the lower members of the panel frame.

4. An interior security door panel for receipt inside the door frame of a stationary glass door and a sliding glass door and adjacent thereto, the door panel preventing the unlawful entrance through the door, the panel comprising:

a stationary panel frame having a first and second side member and an upper and lower member, the stationary panel frame adjacent the stationary glass door;

a sliding panel frame having a first and second side member and an upper member and lower member, the sliding panel frame adjacent the sliding glass door;

cross members attached to the stationary panel frame and sliding panel frame, the cross members disposed in a spaced relationship to each other with the spacing small enough to prevent human entrance therethrough;

A "U" shaped channel attached along the top of the door frame, the "U" shaped channel receiving the upper member of the stationary panel frame and sliding panel frame therein, the "U" shaped channel further having "L" shaped roller hangers extending downwardly therefrom for receiving a pair of rollers attached to the opposite sides of a roller arm, the roller arm attached to the top of the sliding panel frame, the rollers received in the roller hangers allowing the sliding panel frame to be rolled laterally in front of the stationary panel frame; and leveling shoes attached to the lower member of the panel frame for allowing the frame to be adjusted properly inside the door frame.

* * * * *